United States Patent [19]

Harao et al.

[11] 4,217,518

[45] Aug. 12, 1980

[54] DIRECT-VIEWING STORAGE TUBE WITH OPAQUE STRIP ON TRANSPARENT COLLECTOR ADJACENT SCAN AREA

[75] Inventors: Norio Harao; Hiroki Tokizawa; Teruhide Nishikawa, all of Yokohama, Japan

[73] Assignee: Tokyo Shibaura Electric Co., Ltd., Kawasaki, Japan

[21] Appl. No.: 795

[22] Filed: Jan. 3, 1979

Related U.S. Application Data

[63] Continuation of Ser. No. 820,913, Aug. 1, 1977, abandoned, which is a continuation of Ser. No. 649,272, Jan. 15, 1976.

[30] Foreign Application Priority Data

Jan. 17, 1975 [JP] Japan ..... 50-7619

[51] Int. Cl.[2] ..... H01J 29/10; H01J 31/08

[52] U.S. Cl. ..... 313/398

[58] Field of Search ..... 313/398, 820, 91 B

[56] References Cited

U.S. PATENT DOCUMENTS

| | | | |
|---|---|---|---|
| 3,146,368 | 8/1964 | Fiore et al. | 313/408 |
| 3,214,631 | 10/1965 | Anderson | 313/398 |
| 3,313,975 | 4/1967 | Oess | 313/402 |
| 3,339,099 | 8/1967 | Anderson | 313/398 |
| 3,614,820 | 10/1971 | Morris | 313/398 |

*Primary Examiner*—Robert Segal

*Attorney, Agent, or Firm*—Oblon, Fisher, Spivak, McClelland & Maier

[57] ABSTRACT

A storage target capable of storing an electric charge corresponding to an input signal and also converting the stored charge image into a visible form is provided on the inner wall of a faceplate closing the opening of a funnel constituting an evelope of a direct-viewing storage tube. The storage target includes a collector electrode formed on the inner wall of the faceplate; a plurality of fluorescent dot islands provided in contact with the collector electrode; and a dielectric material formed between those of the fluorescent dot islands which are arranged on the outermost peripheral edge of the storage target and a sealed portion joining the opening of the funnel and the faceplate so as to face the collector electrode and surround the effective area of the storage target, thereby preventing the luminescence of that portion of the target which is positioned around the peripheral edge of the effective area of the storage target.

1 Claim, 5 Drawing Figures

DIRECT-VIEWING STORAGE TUBE WITH OPAQUE STRIP ON TRANSPARENT COLLECTOR ADJACENT SCAN AREA

This is a continuation, of application Ser. No. 820,913, filed Aug. 1, 1977, now abandoned, which is a continuation of Ser. No. 649,272, Jan. 15, 1976.

BACKGROUND OF THE INVENTION

This invention relates to a direct-viewing storage tube and more particularly to improvements on the direct-viewing storage tube.

A prior art direct-viewing storage tube generally had the drawback that when the storage tube was put to practical application, undesirable luminescence appeared around the peripheral edge of the effective area of the storage target. Even the so-called meshless type direct-viewing storage tube which was designed to store a charge image and convert the stored charge image into a visible form by means of the same storage target was still accompanied with the disadvantage that undesirable luminescence similarly occurred around the peripheral edge of the effective area of the storage target. This peripheral luminescence should be suppressed to provide a distinct visible picture.

Discussion will now be given of the cause of the appearance of said undesirable luminescence by reference to FIG. 1 showing the direct-viewing storage tube of this invention and FIG. 4 illustrating the construction of the prior art direct-viewing storage target. For comparison with the prior art direct-viewing storage target, relatively detailed description is given of the construction and function of the direct-viewing storage tube of this invention, with the duplicated description omitted.

Referring to FIG. 1 indicating the longitudinal cross section of the direct-viewing storage tube of the invention, the envelope of the storage tube comprises a funnel 1, neck portion 2 and transparent faceplate 3. A storage target 4 is formed on the inner wall of the transparent faceplate 3. The neck portion 2 contains a writing gun 6 for emitting writing beams modulated by input signals. The modulated writing beams scan the storage target 4 through a deflection device 5 provided at a junction between the neck portion 2 and funnel 1. An anode 7 is provided on the inner wall of the funnel 1 to accelerate the writing beams. A pair of reading guns 8 are received in the funnel 1 to emit flood beams to the storage target 4. The aforesaid anode 7 is concurrently used to accelerate the reading beams. Control electrodes for the writing gun 6 and paired reading guns 8 are not indicated. A collimator 9 is fitted to the inner wall of the funnel 1 to emit reading beams to the storage target 4 with a uniform density, and is led out of the storage tube. Positioned between the storage target 4 and collimator 9 is an ion repeller screen 10 to collect secondary electrons released from the storage target 4 and ions remaining in the storage tube. This ion repeller screen 10 is disposed about 5 mm in front of the storage target 4 and led out of the storage tube through an electrode **10*a* fitted on the inner wall of the funnel 1. The ion repeller screen 10 is prepared from a metal wire of, for example, tungsten, stainless steel or nickel, and contains scores or hundreds of meshes. Normally, the cathode of the writing gun 6 is impressed with a voltage of −3 KV and the cathode of each reading gun 8 is set at zero volt. The collimator 9 is supplied with a voltage of 50 to 180 V and the ion repeller screen 10** with a voltage of 300 V.

With a storage tube constructed as described above, deletion of a charge image already stored in the storage target 4 is effected by emitting a flood beam from the paired reading guns 8 to the storage target 4, with a voltage impressed on the back electrode assembly of the storage target 4 slowly changed from 0 to 180 V. Storage of a fresh charge image is carried out by scanning the cleared surface of the storage target 4 by an accelerated writing beam supplied from the writing gun 6. A charge image thus stored is converted into a visible form adapted for direct observation. However, the prior art direct-viewing storage tube had the drawback that while a prestorage operation, or deletion of a previously stored charge image was going on, an annular luminescent portion appeared around the peripheral edge of the effective area of the storage target 4.

This luminescence has been found to originate with the structure of the storage target. The prior art storage target is constructed as shown in FIG. 4. Namely, a transparent collector electrode 11 made of, for example, tin oxide is fitted to the inner wall of the faceplate 3. The opening of the funnel 1 is fused to the faceplate 3 with the collector electrode 11 and a frit glass or low melting glass 12 interposed therebetween. A mesh-like electrode 13 made of, for example, opaque graphite is mounted on the collector electrode 11. A plurality of fluorescent dot islands 14 are embedded in the blank spaces of said mesh-like electrode 13. These fluorescent dot islands 14 are suitably formed of a fluorescent compound of zinc silicate series, for example, $Zn_2SiO_4$:Mn. A relatively broad extension **13*a* of said mesh-like electrode 13 is positioned between those of the fluorescent dot islands 14 which are arranged on the outermost peripheral edge of the storage target 4 and the sealed portion joining the funnel 1 and faceplate 3. With the prior art storage tube comprising a storage target of the above-mentioned construction, the prestorage operation is effected by emitting a reading beam to the storage target 4, while linearly changing the potential of the back electrode assembly (including the transparent electrode 11, mesh-like electrode 13 and extension 13a thereof) from 180 V to 0 V (representing the potential of the cathode of the paired reading guns 8) in a prescribed length of time of, for example, 500 ms. During the above-mentioned prestorage operation, the surface potential of the fluorescent dot islands 14 should be kept at zero volt by means of the zero volt of a reading beam and the insulating property of the fluorescent dot islands 14** themselves.

It has been found that during the prestorage period, part of a reading beam discharged from the paired reading guns 8 is deflected toward the periphery of the target by a distorted electric field caused by the electrode **10*a* connected to the ion repeller screen 10 and the exposed extension 13a of the mesh-like electrode 13, and only a small portion of the reading beam emitted from the paired reading guns 8 reaches the surface of the fluorescent dot islands 14 formed around the storage target 4, particularly those which are arranged on the outermost peripheral edge of the storage target 4. The peripheral fluorescent dot islands 14 on which a required amount of a reading beam does not impinge have the surface potential progressively elevated due to the capacity coupling of the back electrode assembly and the surface of the fluorescent dot islands 14, as the potential of said back electrode assembly rises higher. When the surface potential of the fluorescent dot islands 14 reaches the level at which the secondary electron emission ratio indicates a larger value than 1, then said surface potential becomes substantially equal to the potential of the back electrode assembly. This means that the fluorescent dot islands 14 disposed on the peripheral edge of the storage target 4 are in a state already stored with electric charge. As the result, luminescence appears around the peripheral edge of the storage target 4 with a width of about 5 mm. If the prestorage period, that is, a length of time required for the potential of the back electrode assembly to be changed from 0 V to 180 V is extended, then the surface charge of fluorescent dot islands 14 arranged around the peripheral edge of the storage target 14** can indeed be fully neutralized by a reading beam to reduce the width of the aforesaid luminescence. However, extension of the prestorage period is not acceptable for the practical application of a direct-viewing storage tube.

It is accordingly the object of this invention to provide a direct-viewing storage tube comprising a storage target free from the aforesaid drawbacks accompanying any of the prior art direct-viewing storage tubes.

SUMMARY OF THE INVENTION

The direct-viewing storage tube of this invention is the type in which an envelope contains a writing gun and at least one reading gun, and the opening of a funnel constituting the envelope is sealed with a faceplate having its inner wall provided with a storage target, the storage target comprising a collector formed on the inner wall of the faceplate; a plurality of fluorescent dot islands provided in contact with the collector electrode; and a dielectric material layer formed between those of the fluorescent dot islands which are arranged on the outermost peripheral edge of the storage target and a sealed portion joining the opening of the funnel and faceplate, so as to surround the effective area of the storage target and face the collector electrode.

DETAILED DESCRIPTION OF THE PREFERRED EMBODIMENTS

Figure 1:
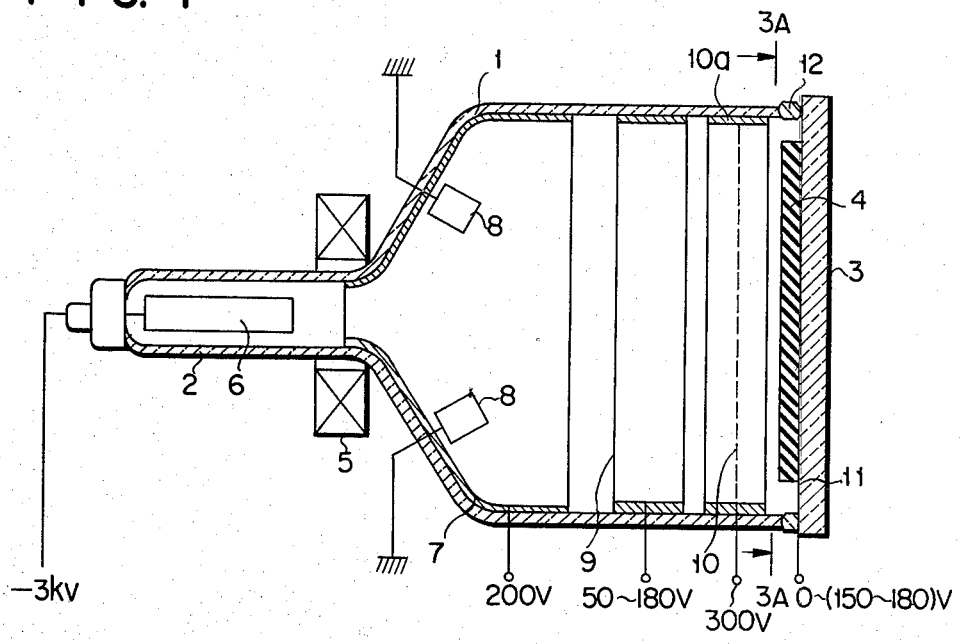
FIG. 1 is a longitudinal sectional view of the direct-viewing storage tube of this invention.
Figure 2:
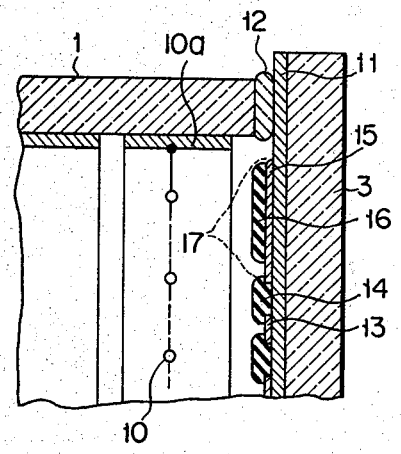
FIG. 2 is a fractional enlarged sectional view of FIG. 1.

Description has already been given of the general arrangement and relative positions of the funnel 1, neck portion 2, faceplate 3, deflection device 5, writing gun 6, anode 7, reading guns 8, collimator 9, ion repeller screen 10 and electrode 10*a* all shown in FIG. 1, any further reference thereto being omitted.

There will now be detailed a storage target 4 used with the direct-viewing storage tube of this invention. This storage target 4 comprises a transparent collector electrode 11 formed of, for example, tin oxide; a mesh-like electrode 13 prepared from opaque material; a plurality of fluorescent dot islands 14 made of, for example, $Zn_2SiO_4$:Mn and embedded in the blank spaces of said mesh-like electrode 13; and opaque conductive material 15 disposed between those of fluorescent dot islands 14 which are arranged on the outermost peripheral edge of the storage target 4 and a sealed portion joining the opening of the funnel 1 and faceplate 3, and a dielectric material 16 mounted on the opaque conductive material 15. A region 17 containing the opaque conductive material 15 and dielectric material 16 should be preferred to have a width about 10 to 50 times the diameter of a single fluorescent dot island 14. Said region 17 is continually formed so as to surround the effective area of the storage target 4 as illustrated in enlargement in FIG. 3A. The aforesaid opaque conductive material 15 may be of a nonconductive type.

The dielectric material 16 well serves the purpose, provided it has a high insulating property. If said dielectric material 16 is made of the same kind of fluorescent compound as that which constitutes the fluorescent dot islands 14, then said dielectric material 16 can be provided at the same time as the fluorescent dot islands 14, offering considerable advantage in manufacturing the direct-viewing storage tube.

Figure 4:
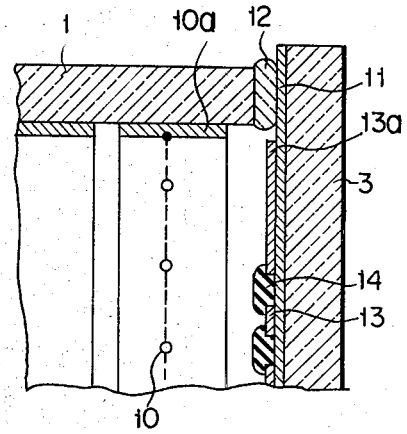
FIG. 4 PRIOR ART
FIG. 4 is a sectional view of that portion of the prior art direct-viewing storage tube which corresponds to FIG. 2.

With the direct-viewing storage tube of this invention comprising a storage target constructed as described above, it has been found that where the potential of the collector electrode 11 is, as previously described, sharply reduced from 180 V to 0 V in the initial stage of the prestorage period and thereafter is raised conversely from 0 V to 180 V in a prescribed length of time, then fluorescent dot islands 14, arranged around the peripheral edge of the storage target 4 do not substantially present luminescence as was observed in the prior art direct-viewing storage tube having a construction illustrated in FIG. 4. This advantageous effect of the present invention is supposed to originate with the fact that the distortion of an electric field created around the sealed portion joining the opening of the funnel 1 and the faceplate 3 is restricted by a decrease in the exposed area of the back electrode assembly and the presence of the fluorescent dielectric material 16 and that a far larger capacity is provided between the surface of said fluorescent dielectric material 16 and back electrode assembly than between the surface of a single fluorescent dot island and the back electrode assembly. Namely, where the fluorescent dielectric material 16 is mounted on the opaque conductive material 15 without exposing the latter. then a prestorage operation can be undertaken under the condition in which an electric field generated between those of the fluorescent dot islands 14 which are disposed on the outermost peripheral edge of the storage target 4 and the fluorescent dielectric material 16 has its distortion prominently reduced. Where a writing beam enters the fluorescent dielectric material 16 at the time of fresh storage, undesirable luminescence does not take place, because said fluorescent dielectric material 16 has a fully large capacity. Since, however, impingement of a considerable amount of writing beam into the fluorescent dielectric material 16 brings said material into a storage state, possibly giving rise to its luminescence, the directviewing storage tube of this invention comprises the opaque conductive material 15, in case the fluorescent dielectric material 16 is used. That portion of the fluorescent dielectric material 16 which lies very close to the sealed portion joining the opening of the funnel 1 and faceplate 3 receives only a small amount of reading beam and consequently tends to have its surface potential increased. Since, however, the fluorescent dielectric material 16 has a large area and a great deal of reading beam is emitted to said fluorescent dielectric material 16 as a whole, a local surface charge thereof is substantially neutralized, suppressing the possibility of luminescence being presented around the peripheral edge of the storage target 4.

Figure 3A:
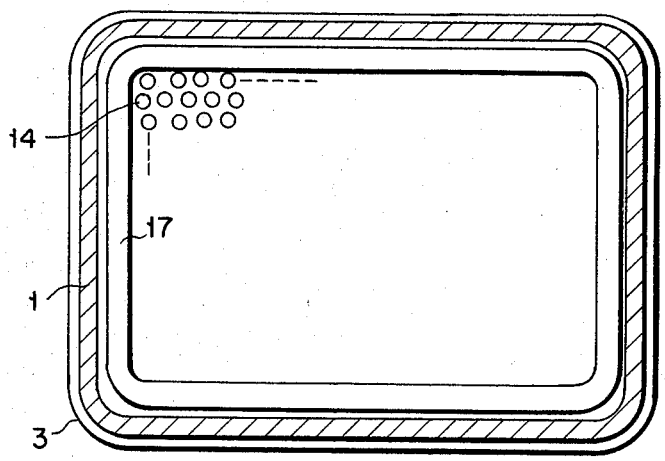
FIG. 3A is a sectional view on line 3A—3A of FIG. 1.
Figure 3B:
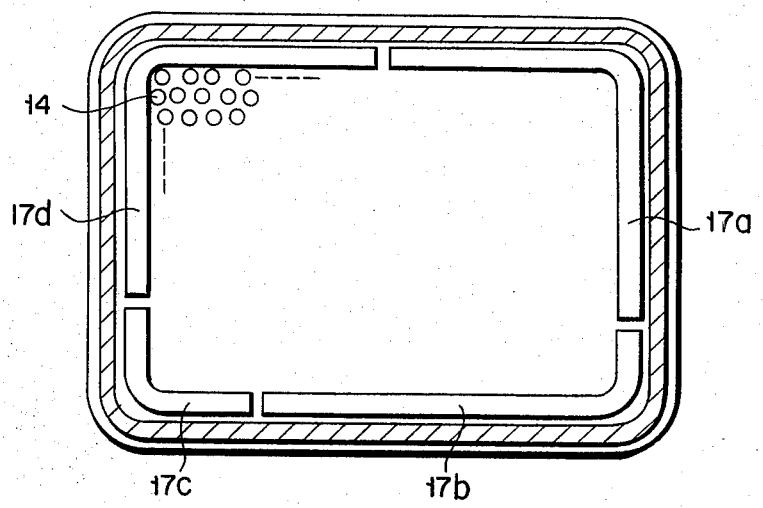
FIG. 3B shows a modification of the storage target of FIG. 3A.

Referring to FIG. 3B showing a modification of the storage target of this invention, the region 17 of FIG. 3A is divided into four subregions 17*a* to 17*d*. If each subregion is formed with a far larger area (for example, scores of times larger) than that of a single fluorescent dot island, then the object of this invention can be attained all the same.

What we claim is:

1. A direct-viewing storage tube having an envelope containing a writing gun and at least one reading gun and a storage target provided on the inner wall of a faceplate sealing the opening of a funnel constituting the envelope, wherein the storage target comprises a transparent collector electrode formed on the inner wall of the faceplate; a mesh-like electrode made of opaque material, bored with a plurality of apertures and mounted on the collector electrode; a plurality of fluorescent dot islands embedded in said apertures in contact with the transparent collector electrode; an opaque layer provided on the transparent collector electrode lying between those of the fluorescent dot islands which are arranged on the outermost peripheral edge of the storage target and a sealed portion joining the opening of the funnel and faceplate so as to continuously surround the effective areas of the storage target; and a fluorescent layer formed of the same kind of fluorescent compound as that which constitutes the fluorescent dot islands and mounted on the opaque material so as to continuously surround the effective area of the storage target, said fluorescent layer mounted on said opaque material having a width of at least ten times the diameter of said fluorescent dot island;

whereby the capacitance of said fluorescnet layer is substantially greater than that of said adjacent peripheral dot islands and said fluorescent layer thereby neutralizes local surface charge formed thereon, thereby suppressing luminescence of said fluorescent layer.

* * * * *